United States Patent [19]

Taddicken

[11] 4,173,191

[45] Nov. 6, 1979

[54] SEWING UNIT WITH SECTIONWISE SHIFTABLE CLAMPING DEVICE

[75] Inventor: Hermann Taddicken, Schwäbisch-Gmünd, Fed. Rep. of Germany

[73] Assignee: Eisele Apparate- und Gerätebau GmbH, Fed. Rep. of Germany

[21] Appl. No.: 937,976

[22] Filed: Aug. 30, 1978

[30] Foreign Application Priority Data

Sep. 2, 1977 [DE] Fed. Rep. of Germany ... 7727206[U]

[51] Int. Cl.[2] ..... D05B 3/00

[52] U.S. Cl. ..... 112/65; 112/113; 112/121.11; 112/304; 112/311

[58] Field of Search ..... 112/113, 203, 207, 121.15, 112/121.11, 65, 70, 67

[56] References Cited

U.S. PATENT DOCUMENTS

| | | | |
|---|---|---|---|
| 2,164,501 | 7/1939 | Cundall et al. | 112/203 X |
| 2,297,295 | 9/1942 | Flintjer | 112/203 X |
| 2,899,919 | 8/1959 | Myska | 112/67 |
| 3,073,267 | 1/1963 | Reeber et al. | 112/121.11 |
| 3,082,719 | 3/1963 | Zeitlin | 112/65 |
| 3,087,440 | 4/1963 | Flach et al. | 112/203 |
| 3,127,857 | 4/1964 | Medoff et al. | 112/113 |
| 3,322,083 | 5/1967 | Perrella et al. | 112/67 |
| 3,334,600 | 8/1967 | Conner | 112/67 |
| 4,114,545 | 9/1978 | Manabe et al. | 112/121.15 |

*Primary Examiner*—Ronald Feldbaum
*Attorney, Agent, or Firm*—McGlew and Tuttle

[57] ABSTRACT

A device for feeding materials in a feed direction for operations thereon, such as sewing buttons or buttonholes, either directly on the material or onto separate strips of material which are fed thereto. The device includes means for clamping the material which is to be sewn so that it does not shift as it is moved through a stitching area. A movable carriage is mounted on a support frame for movement backwardly and forwardly in respect to the direction of material feeding, and it carries a lower endless conveyor arranged beneath and cooperable with an upper endless conveyor so that the endless belt stretched thereon may be biased together during the feeding operation so that the material is clamped along its entire length as it is fed with the movement of the carriage. The apparatus includes a separate clamping device for clamping the forward edge of the material at the end thereof which is beyond the sewing needle operating area and this is also movable with the carriage. The carriage is moved by a friction feed arrangement which includes a rotatable drive shaft which is engaged by a friction drive carried by the carriage and which includes rollers which may be oriented so as to bear against the shaft at an angle on its periphery so as to cause an advancing movement of the friction drive with the carriage at a rate controlled by the positioning of the friction rollers.

14 Claims, 5 Drawing Figures

SEWING UNIT WITH SECTIONWISE SHIFTABLE CLAMPING DEVICE

FIELD AND BACKGROUND OF THE INVENTION

This invention relates in general to a device for feeding material and, in particular, to a new and useful device for feeding strips of material through a needle stitching area, such as a button sewing machine, and which includes a carriage carrying two endless conveyor gripping belts for gripping the material being fed along an extended area as it is advanced through the stitching point.

DESCRIPTION OF THE PRIOR ART

Prior to sewing on buttons or sewing buttonholes in shirt or blouse front parts, the edge of the front part is folded over for the formation of a button or buttonhole strip, with the possible addition of a strengthening insert, clamped at the front and rear ends as seen in the feeding direction and shifted sectionwise to the stitch-forming point of a button or buttonhole sewing machine to sew on the buttons or to sew the buttonholes.

In the known sewing equipment of this kind, the so-called opening up of the folded button hole strip, which is merely clamped at the front and rear ends, can be avoided only by keeping it taut in lengthwise directions or pressing it flat beforehand. However, the additional pressing operation should be avoided, if possible, for reasons of economy. Since the material being sewn must be movable relative to the clamping device, for the execution of the individual sewing operation, such as, in a buttonhole sewing machine, and in order to be able to follow the fabric clamp, it should permit the raising of the button clamp with the material being sewn in order to break the thread when sewing on buttons. In addition, the lengthwise tension of the button or buttonhole strip must be relieved prior to sewing a buttonhole, or after sewing on a button, and this is accomplished in the known devices by pivoting of the clamping members.

After relieving the lengthwise tension, however, it is very easy for the material being sewn to deform due to its inherent elasticity. This deformation is very great in tricot and knit materials and in other highly elastic fabrics and leads to a crinkle effect not only in the area of the sewn parts stiffened by the sewing, but also to the folded edge deviating from a straight line due to the opening up of the folded material being sewn. This is particularly conspicuous in patterned, particularly checkered, fabrics and accordingly cannot be tolerated.

SUMMARY OF THE INVENTION

It is the purpose of the invention to avoid a deformation of the material being sewn between the individual sewing operations. In accordance with the invention, a sewing unit is constructed in a manner such that the material being sewn is feedable over the entire length before the stitch-forming point in the area of the button or buttonhole strip without shifting and without tension. By the pressing together of the endless conveyor belt strands clamping the button or buttonhole strip between them, including the clamping device transmitting the feeding motion to the endless conveyors, both endless belts are caused to run in synchrony so that a deformation of the sewing material is prevented with certainty.

The thread is generally cut or broken at the end of the button sewing operation by raising the button clamp. To provide for length compensation for this process and to thereby prevent the material being sewn from distortion, the clamping device disposed behind the stitch-forming point is movable in a plane which is inclined with respect to the vertical direction towards the sewing machine.

Accordingly, it is an object of the invention to provide a device for feeding materials in a feed direction for operation thereon, such as sewing, which comprises a support frame with a carriage mounted on the frame for movement backwardly and forwardly in respect to the direction of the material feed and which mounts a lower endless conveyor extending in the feed direction below an upper endless conveyor also extending in the feed direction and disposed over, and cooperable with, the lower endless conveyor and which includes means for biasing the endless conveyors together for cooperable clamping engagement with a workpiece positioned therebetween and drive means connected to the carriage to drive it in predetermined time relationship to the operations to be performed on the material.

Another object of the invention is to provide a button sewing machine which includes means for feeding buttons into association with a reciprocating needle at a stitch-forming area, and means for clamping a length of material and for feeding the material through the button stitching area which comprises upper and lower endless conveyors which are biased together to engage the material therebetween and which further includes a separate clamping element carried by the carriage engageable with the forward end of the material on the opposite side of the stitch-forming area from the endless conveyors at the start of the operation and which further includes means connected to the carriage to drive it in timed relationship so as to advance the material through the stitching area.

A further object of the invention is to provide a material feeding device for a sewing machine, wherein the material is fed by a clamping arrangement extending along a considerable portion of its length and by a feed means which moves the material in stepped feeding movements controlled by the positioning of stopping cams.

Another object of the invention is to provide a sewing unit with a sectionwise shiftable clamping device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

DESCRIPTION OF THE PREFERRED EMBODIMENT

Figures 1, 2, 3, 4, 5:
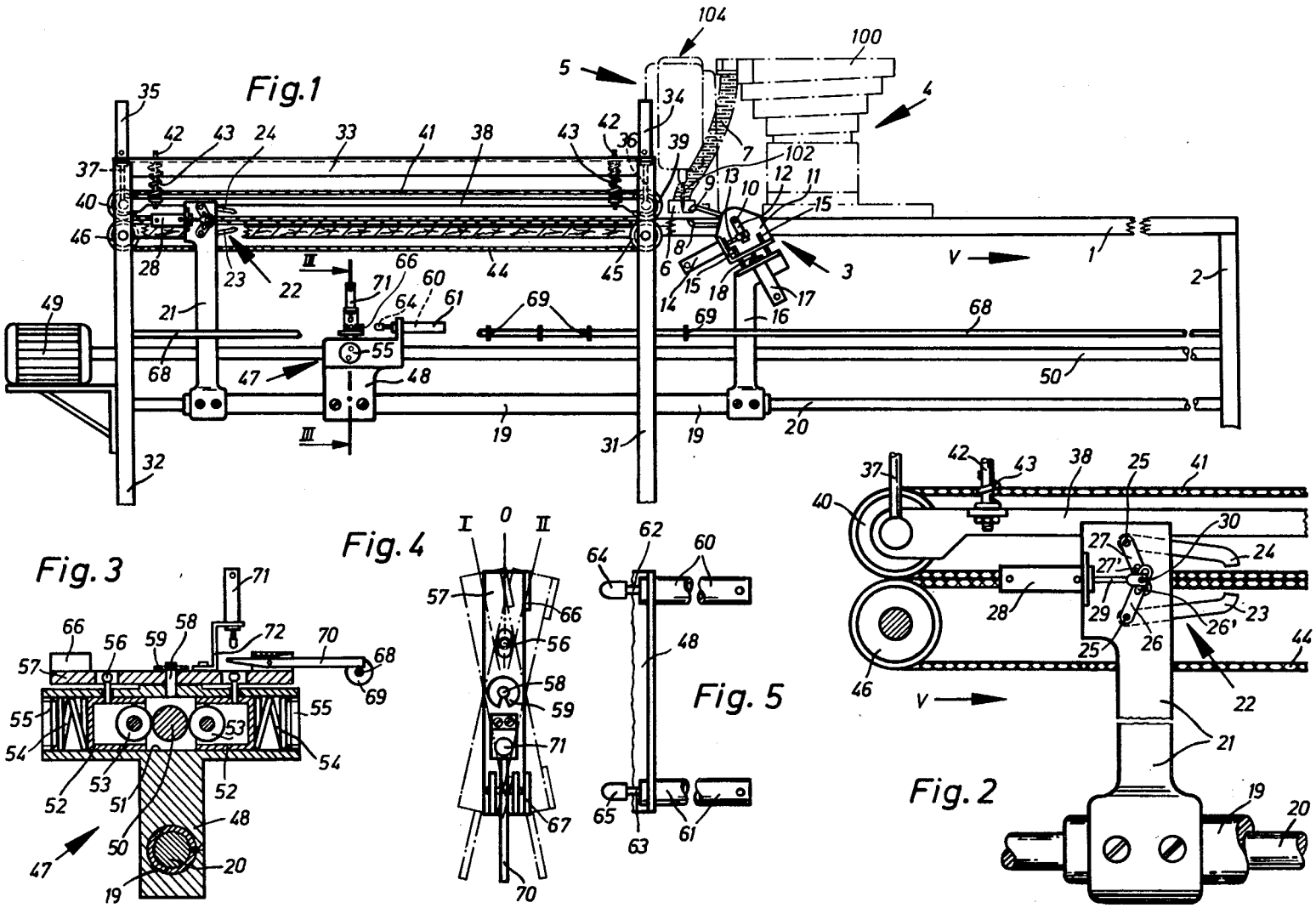
FIG. 1 is a rear elevational view of a button applying machine having a clamping and feeding device for the material constructed in accordance with the invention.
FIG. 2 is an enlarged partial elevational view of the conveyor clamping mechanism.
FIG. 3 is a section taken along the line III—III of FIG. 1.
FIG. 4 is a top view of the shifting lever of the feed drive shown in FIG. 3.
FIG. 5 is a top view of the pneumatic operating cylinders for actuation of the feed drive shifting lever.

Referring to the drawing in particular, the invention embodied therein, comprises, a button applying machine which includes a button feeder, generally designated 4, which includes a vibrating hopper 100 for advancing buttons to a chute 7 for feeding to a clamp 6 located at a stitch-forming area below a needle 102 of a sewing machine, generally designated 104.

In accordance with the invention, a considerable length of the material to be sewn, either separately or together with another material strip, is clamped along a considerable length of the material by clamping means, generally designated 22, which includes clamping jaw members 23 and 24, as well as an upper endless belt conveyor 41 and a lower endless belt conveyor 44 which are advanced with a carriage or traveling sleeve 19 which also carries a separate clamping device 3 for engaging the forward edge of the material as well as drive means, such as a friction roller drive 47.

A button feeding device 4 and a button sewing machine 5 are mounted on the table top 1 of frame 2 of the sewing unit, in front, relative to FIG. 1, of the vertical plane of a clamping device 3 which acts like pincers for the front end of the material being sewn. The raisable button clamp 6 of the sewing machine 5 is connected to a known button loading device through a flexible feeding chute 7 to a hopper 100. Hopper 100, sewing machine 5, button clamp 6 and feeding chute 7 are indicated by dash-dotted lines in FIG. 1.

The clamping device 3 is mounted behind a stitch-forming point under needle 102 of the sewing machine 5, as seen in the feeding direction, designated by an arrow V in FIGS. 1 and 2. The device 3 comprises a fixed arm 8 and a movable arm 9 which interacts with the fixed arm 8 to clamp the front end of the button strip of a shirt or blouse front part. The movable arm 9 sits on a shaft 10 mounted in a bearing part 11. The shaft 10 supports a lever 12 to which is connected the piston rod 13 of a single-acting pneumatic cylinder 14 mounted to the bearing part 11. The bearing part 11 of the clamping device 3 is guided so as to be movable on two guide rods 15 mounted to a beam 16 such that they are inclined towards the stitch-forming point of sewing machine 5.

Clamping device 3 can be moved along guide rods 15 by means of a pneumatic cylinder 17 mounted to beam 16 and having a piston rod 18 attached to bearing part 11. The beam 16 is fastened to a traveling sleeve or carriage 19 guided so as to be movable lengthwise on a slide rod 20 fastened to frame 2. A beam 21 for a clamping device 22 (FIGS. 1 and 2) is fastened to the other end of the traveling sleeve 19 and it operates like pincers in the manner of the clamping device 3. Clamping device 22 comprises two arms 23 and 24 (FIG. 2), each fastened to a separate shaft 25. Both of the arms 23 and 24 are rotatably mounted in the beam 21 and support a respective lever 26 and 27 at their free end, and each are provided with a respective longitudinal slot 26' and 27'.

A double-acting pneumatic cylinder 28 mounted to the beam 21 serves to open and close the clamping device 22 in that the pneumatic cylinder's piston rod 29 is connected to the levers 26 and 27 by means of a bolt 30 going through the longitudinal slots in the respective levers 26 and 27.

Two feet 31 and 32 (FIG. 1) of the frame 2 are extended upwardly and are interconnected at their upper ends by a rail 33 of an L-shaped profile. As seen in FIGS. 1 and 2, two single-acting pneumatic cylinders 34 and 35, with their respective piston rods 36 and 37 fastened to a pressure shoe 38, are mounted to the rail 33. Guide pulleys 39 and 40, respectively, are mounted at both ends of the pressure shoe 38. An endless conveyor in the form of an endless ribbon or endless belt 41 is tightened around the guide pulleys 39 and 40. For the straight guidance of the pressure shoe 38, two longitudinally spaced guide rods 42, 42 are fastened to the shoe and slide in holes in the rail 33. A compression spring 43 is mounted on each guide rod 42 between the rail 33 and the pressure shoe 39 to press the pressure shoe 38 and, with it, the endless belt 41, against the table top 1 or the material to be sewn, respectively. If needed, additional pressure rolls or pressure pads may be provided on the pressure shoe 38 between the upper and the lower strands of the endless belt 41.

An endless conveyor designed as an endless belt 44 which is guided by guide rolls 45 and 46, interacting with the upper endless belt 41, is mounted to the legs 31 and 32, respectively. For purposes of safety against lateral shifting, the upper strand of the endless belt 44 runs in a groove in the table top 1 at the same level as the top side of the table top 1. Both endless belts 41 and 44 extend parallel to the feed direction of the material to be sewn, shown at arrow V in FIGS. 1 and 2, in front of the stitch-forming point in the area in which the button strip is positioned between the interacting strands of the endless belts 41 and 44 to sew on the buttons. The arms 23 and 24 of clamping device 22 are designed so that the interacting working strands of the two endless belts 41 and 44 can be pressed together by the arms 23 and 24.

As seen in FIGS. 1 and 3, a known friction roller feed drive 47 serves the purpose of shifting the clamping device 3 and clamping device 22 sectionwise and, hence, of the endless belts 41 and 44 and of the material to be sewn. The housing 48 of friction roller feed drive 47 is mounted to the traveling sleeve 19. A shaft 50 is mounted in the frame 2 and penetrates the housing 48, and it is driven at a constant speed by a motor 49, seen in FIG. 1, which is mounted to the frame 2. Cylindrical friction roller supports 52, 52 are each rotatably mounted in a hole 51 extending perpendicular to the longitudinal axis of shaft 50 on both sides of shaft 50. Each support has a friction roller 53 mounted at an end of the support which opens towards the shaft 50. A respective compression spring 54 pushes each friction roller support 52 with the associated friction roller 53 against the shaft 50.

A threaded plug 55 is provided to vary the spring force. To change the approach angle of the friction rollers 53 relative to the shaft 50, the friction roller supports 52 are adjustable angularly in order to derive a feeding force from the revolving shaft 50, acting upon the housing 48 and the traveling sleeve 19 connected to housing 48. For this purpose, a ball head pin 56 is mounted in each friction roller support 52. Each ball head pin 56 is led to the outside through a slot in the housing 48, with its spherical free end penetrating a longitudinal slot in a shifting lever 57 (FIGS. 3 and 4), mounted so as to be pivotable about a bolt 58 on the housing 48 and secured in axial directions by a locking washer 59.

The shifting lever 57 is shifted by two single-acting pneumatic cylinders 60 and 61 (FIGS. 1 and 5), mounted to the housing 48 and having piston rods 62 and 63, respectively, which are each spring-loaded by a return spring. A pressure pad 64 is attached to the piston rod 62 of pneumatic cylinder 60, and a pressure pad 65 is attached to the piston rod 63 of pneumatic cylinder 61. Pressure pad 64 engages a counterpad 66 (FIGS. 3 and 4) and the pressure pad 65 engages a counterpad 67 of the shifting lever 57 in order to pivot it into the position indicated in FIG. 4 by dash-dotted lines and marked I and II, respectively.

The various stopping positions of the material being sewn are determined by cams 69 adjustably mounted to a supporting bar 68 (FIG. 1) fixed in the frame, in cooperation with a dual-armed starting lever 70 (FIGS. 3 and 4) which is pivotably mounted to the shifting lever 57 and has arms of different lengths. The longer arm cooperates with the cams 69.

Before a feeding step can be executed, or before the clamping device 3 and the clamping device 22 can be returned to their starting positions upon the conclusion of the last button sewing operation, the starting lever 70 must be pivoted out of the range of the cams 69. A single-acting pneumatic cylinder 71 (FIGS. 1, 3 and 4) is provided for this purpose and it is mounted to an angle 72 on the shifting lever 57, with its piston rod being spring-loaded by a return spring disposed in the cylinder.

The pneumatic cylinders 14, 17, 28, 34, 35, 60, 61 and 71 are connected in the usual manner to a compressed air source via flexible tubing and are controlled by electromagnetically switchable valves. The selection and configuration of the valves and the design of the valve controls of the button sewing machine and the button feeding mechanism are along conventional lines for such sewing units so that it is unnecessary to illustrate and describe them here in greater detail.

Assuming that the button sewing machine 5 has been stopped with the needle in the up position and that the button clamp 6, loaded with a button ready to be sewn on is raised; the traveling sleeve 19 with the feed drive 47 and the open clamping device 3 with the clamping device 22 also open, assume the starting position shown in FIG. 1; the pressure shoe 38 with the upper endless belt 41 is raised countering the action of the springs 43 by the cylinders 34 and 35; the shifting lever 57 is in its neutral center position marked "O" (FIG. 4); the shaft 50, driven by motor 49, is rotating; and that the button strip of a workpiece has been formed, preferably during the transfer into the button sewing position, by the insertion of a metal sheet and folding the edge of the material to be sewn over once and the start of the button strip of the workpiece brought under the button clamp 6 between the open arms 8 and 9 of the clamping devices and between the interacting strands of the endless belts 41 and 44. Starting from this premise, the sewing unit operates as follows:

Pneumatic cylinders 14, 28, 34 and 35 are controlled by actuating a starting switch, so that the pressure shoe 38 with the endless belt 41 is lowered to the button strip by the action of the springs 43, and the arms 8 and 9, 23 ad 24 are closed. This clamps the button strip of the workpiece over its entire length, except for the area intended for the first button to be sewn on, the interacting strands of the endless belts 41 and 44 being pressed together by the clamping device 22.

The button clamp 6 is then lowered to the material being sewn, and the sewing machine 5 is started to sew on the first button. When the button is sewn on and the sewing machine has stopped, the closed clamping device 3 is raised obliquely upwards toward the sewing machine by admitting compressed air to the pneumatic cylinder 17, thereby, reducing the distance between the clamping points of teh clamping device 3 and the endless belts 41 and 44 at the guide rollers 39 and 45, thus loosening the fabric so that, when raising the button clamp 6 to break the thread, the fabric can be lifted by the sewn-on button.

Thereupon, the button clamp 6 is opened, a new button is inserted into the button clamp, and compressed air is supplied to the pneumatic cylinders 60 and 71. This causes the removal of the longer arm of the starting lever 70 out of the range of the cams 69 and a pivoting of the shifting lever 57 into the position marked I in FIG. 4. By this motion, the shifting lever 57 turns the friction rollers supports 52 with the friction rollers 53 into an angular position via the ball head pins 56 in which the friction rollers 53 assume an approach angle to the revolving shaft 50 deviating from 90°.

From the shaft 50, through the feed drive 47, a linear feeding motion is derived in the direction of arrow V, as seen in FIGS. 1 and 2, for the traveling sleeve or carriage 19 and the beams 16 and 21 which are attached to it and carry the devices 3 and 22. During this feeding motion, the endless belts 41 and 44 are moved synchronously by the clamping device 22. Accordingly, a relative shifting of the layers of material being sewn cannot take place during the sectionwise shifting.

As soon as the raised longer arm of the starting lever 70 has passed the first cam 69 during the shifting motion, the supply of compressed air to the pneumatic cylinder 71 is interrupted so that the starting lever 70 drops back into its working position, shown in FIG. 3, in which it runs against the next cam 69, thereby, pivoting the shifting lever 57 into its neutral center position "O" (FIG. 4), after interrupting the supply of compressed air to the pneumatic cylinder 60, in which shifting lever position, the feeding motion is zero, and hence, the position at which to sew on the next button is reached. In this position, the supply of compressed air to the pneumatic cylinder 17 is interrupted. The return spring disposed in the cylinder pushes the clamping device 3 down, returning it into its working position, whereupon, the button sewing operation described above is repeated.

All of the buttons are sewn to the button strip in this manner. When the last button is sewn on and the thread is cut by lifting the button clamp 6, the arms 8 and 9, 23 and 24 of devices 3 and 22 are opened and pressure shoe 38 with endless belt 41 are lifted off of the material being sewn by the pneumatic cylinders 34 and 35. The workpiece may now be removed, for example, by a stacker.

Compressed air is now admitted to the pneumatic cylinders 61 and 71. The longer arm of the starting lever 70 is moved out of the range of the cams 69 by the piston rod of the pneumatic cylinder 71, and the shifting lever 57 is pivoted into position II, as seen in FIG. 4, by the piston rod 63 of the pneumatic cylinder 61. This turns the friction rollers 53 into an angular position in which the feed drive 47 with the traveling sleeve 19 and the devices 3 and 22 are returned to their starting position, according to FIG. 1. Shortly before reaching the starting position, the compressed air supply to the pneumatic cylinders 61 and 71 is interrupted, the longer arm of the starting lever 70 drops down into the range of one of the cams (not shown) and determines the starting position.

Due to the lever 70 striking these stopping cams, the shifting lever 57 is pivoted into its neutral center position "O" (FIG. 4) and the components are stopped in a starting position. After the next workpiece with the folded button strip has been inserted and clamped between the endless belts 41 and 44 and the devices 3 and 22, the cycle which has been decribed above can begin again.

While a specific embodiment of the invention has been shown and described in detail to illustrate the application of the principles of the invention, it will be understood that the invention may be embodied otherwise without departing from such principles.

What is claimed is:

1. A device for feeding materials in a feed direction for operations on the materials, such as sewing, comprising, a support frame, a carriage mounted on said frame for movement backwardly and forwardly in respect to the feed direction of the material, a lower endless conveyor extending in a feed direction comprising longitudinal guide rollers and an endless belt trained over said rollers supported on said carriage, and upper endless conveyor belt extending in the feed direction and disposed over and cooperable with said lower endless conveyor and comprising longitudinally spaced guide rollers and an endless belt trained over said rollers supported on said carriage, biasing means biasing said upper and lower endless conveyors together for clamping the material therebetween along a considerable length of the material and for feeding the material in the feed direction, and drive means connected to said carriage for driving said carriage to move the material in predetermined timed relationship to the operations to be performed thereon.

2. A device, as claimed in claim 1, including separate clamping means on said carriage engageable with the material being fed at a spaced location from said upper and lower endless conveyors.

3. A device, as claimed in claim 2, wherein said separate clamping means comprises first and second pivotal closable jaws engageable with the material and means mounting said jaws on said carriage for movement obliquely relative to the feed direction.

4. A device, as claimed in claim 1, wherein said biasing means comprises a spring biasing said upper conveyor in a direction toward said lower conveyor.

5. A device, as claimed in claim 1, wherein said lower conveyor has an upper reach upon which the material is fed, said upper conveyor having a lower reach engaging the material overlying said lower conveyor, said biasing means comprising a clamping jaw mounted for pivotal movement on respective sides of said upper reach of said lower conveyor and said lower reach of said upper conveyor and being movable together to clamp the reaches together during feeding.

6. A device, as claimed in claim 1, wherein said drive means comprises a friction roller housing having a central bore therethrough and having at least one bore intersecting said central bore, a rotatable motor having a rotatable drive shaft supported within the central bore of said housing, a friction roller support sleeve rotatably supported in the other bore of said housing disposed at an angle to said main bore, said friction roller support having a roller supported therein engaged with said main shaft, and means for rotating said friction roller support to shift said friction roller so that the axis thereof is moved at a parallel with the axis of said main shaft to cause said friction roller to engage the surface of said main shaft so as to move in a cyclical path thereover.

7. A device, as claimed in claim 6, including a shifting lever pivotally mounted on said housing, said friction roller support having a pin thereon engageable into a slot of said shifting lever, said shifting lever being pivotal to move said pin to rotate said friction roller support and shift the axis of said friction roller relative to the axis of said main shaft.

8. A device, as claimed in claim 7, including a control member having a plurality of cams thereon arranged at spaced locations comparable to the starting and stopping of the feeding of the workpiece, a starting lever pivotally mounted on said shifting lever and extending outwardly therefrom in a position to contact each stopping cam in succession and means for pivoting said starting lever to move it out of the way of said cams after said cam causes the stopping of the movement of said shifting lever and the axial displacement of said carriage to again permit movement of said shifting lever and the continued axial displacement of said carriage relative to said main shaft.

9. A machine for sewing buttonholes and buttons onto garments which are moved past a reciprocating needle which overlies a stitching area in which a button is clamped at the area for sewing to the garment, comprising, a support frame having a table portion over which the material is advanced, a guide rod carried by said support frame, a carriage movable along said support frame in a direction to the stitching area and away from the stitching area, first and second endless conveyors arranged in overlying relationship and extending in the feed direction being engageable with the material to be fed along the length of the material, means for biasing said first and second conveyors together to clamp the material therebetween, and drive means connected to said carriage for shifting said carriage with said first and second conveyors along the feed path.

10. A machine for sewing buttonholes and buttons onto garments, as claimed in claim 9, including a rail mounted on said frame, means for suspending said upper conveyor over said lower conveyor from said rail and a spring for biasing said upper conveyor in a direction toward said lower conveyor.

11. A machine for sewing buttonholes and buttons onto garments, as claimed in claim 10, including motor means connected to said upper conveyor for raising and lowering it relative to said lower conveyor.

12. A machine for sewing buttonholes and buttons onto garments, as claimed in claim 9, including first and second clamping members on said carriage disposed on respective sides of said first and second conveyors and engageable with portions of said conveyors to urge the portions in engagement with the material together.

13. A machine for sewing buttonholes and buttons onto garments, as claimed in claim 12, including an upright beam carried on said carriage and having an oblique mounting base, a clamping driver mounted on said inclined base and being displaceable upwardly and downwardly relative to said base at an oblique angle to the feed direction, said clamping driver including clamping jaws engageable with the forward end of the material at a spaced location from said first and second conveyors.

14. A machine for sewing buttonholes and buttons onto garments, as claimed in claim 9, including a drive motor having a rotatable shaft, a friction drive carried on said carriage including a drive housing through which said main shaft extends, a friction roller support rotatably mounted in said drive housing at an angle to said drive shaft, a friction roller carried by said friction roller support rotatably engaged with said shaft and being rotated by said shaft, and means for shifting said friction roller support to orient said friction roller with its axis at an angle to the axis of said shaft so that continued rotation of said shaft produces a relative motion of said housing with said carriage relative to said shaft to shift said carriage along the material feed direction.

* * * * *